US007159797B1

(12) United States Patent
Lammers

(10) Patent No.: US 7,159,797 B1
(45) Date of Patent: Jan. 9, 2007

(54) SPRAY HEAD

(75) Inventor: Daniel A. Lammers, St. Louis, MO (US)

(73) Assignee: Control Devices, Inc., St. Louis, MO (US)

( * ) Notice: Subject to any disclaimer, the term of this patent is extended or adjusted under 35 U.S.C. 154(b) by 0 days.

(21) Appl. No.: 11/425,248

(22) Filed: Jun. 20, 2006

(51) Int. Cl.
*A62C 31/02* (2006.01)
*B05B 3/04* (2006.01)

(52) U.S. Cl. ..... 239/394; 239/390; 239/391; 239/395; 239/397; 239/436; 239/449; 239/538; 285/317; 285/308

(58) Field of Classification Search ..... 239/390–397, 239/436–449, 451–460, 525–532, 538, 239, 239/381; 285/317, 308, 403
See application file for complete search history.

(56) References Cited

U.S. PATENT DOCUMENTS

| | | | | |
|---|---|---|---|---|
| 1,639,328 | A | 8/1927 | Coberly | |
| 2,510,356 | A | 6/1950 | Werts | |
| 2,994,344 | A | 8/1961 | Kerley | |
| 3,516,611 | A | 6/1970 | Piggott | |
| 3,637,142 | A | 1/1972 | Gassaway | |
| 3,675,851 | A | 7/1972 | Merfeld et al. | |
| 3,825,187 | A | 7/1974 | Tatge | |
| 4,869,285 | A | 9/1989 | Dahlin et al. | |
| 5,238,221 | A | 8/1993 | Schwaderer et al. | |
| 5,386,940 | A | 2/1995 | Berfield | |
| 5,433,384 | A * | 7/1995 | Chan et al. | 239/449 |
| 5,556,037 | A | 9/1996 | Wood | |
| 5,884,847 | A | 3/1999 | Christopher | |
| 6,123,272 | A | 9/2000 | Havican et al. | |
| 6,398,134 | B1 * | 6/2002 | Hickson et al. | 239/394 |
| 6,435,427 | B1 | 8/2002 | Conroy | |
| 6,460,783 | B1 * | 10/2002 | Christopher | 239/394 |

* cited by examiner

*Primary Examiner*—Dinh Q. Nguyen
(74) *Attorney, Agent, or Firm*—Senniger Powers

(57) ABSTRACT

A spray head for discharging fluid includes a turret assembly in which a nozzle carrier is rotatable relative to a housing about an axis, and a plurality of nozzles mounted on the carrier radially outward from the axis. The carrier is mounted for linear movement relative to the housing along the carrier axis from a retracted position in which one of the nozzles is mated with an outlet in the housing for discharging fluid, to an extended position in which the carrier is rotatable about the carrier axis to align a different nozzle with the outlet, and back to the retracted position in which the different nozzle is mated with the outlet. A latch on the housing is moveable radially with respect to the carrier axis between a latching position holding the carrier in the retracted position and a release position allowing the carrier to move to the extended position.

20 Claims, 12 Drawing Sheets

SPRAY HEAD

BACKGROUND OF THE INVENTION

The invention relates generally to spray nozzles for discharging fluid, and more particularly to a spray nozzle assembly having multiple spray nozzles for discharging fluid from a selected spray nozzle.

Spray nozzles are often used to alter the flow of fluid from a fluid source, such as from a pressure washer. The nozzles are typically used to create a fan spray of fluid droplets from a solid stream of fluid, and can be configured to produce different fan spray patterns, different flow rates, or different droplet sizes.

Different spray configurations are desirable in different applications. For example, it may be desirable to use a high velocity and relatively solid stream of fluid for difficult cleaning operations such as removing rust or paint from surfaces. Alternatively, it may be desirable to use a low velocity, dispersed stream of fluid for delicate cleaning operations such as cleaning an automobile.

Individual nozzles are available to provide different spray patterns. A female quick connect connector may be mounted on the free end of the fluid source for receiving a male end of the nozzle. When a different spray pattern is desired, the nozzle can be quickly detached from the fluid source and replaced with a different nozzle. Although this works well, it can be difficult to keep track of the different nozzles. The traditional quick connect connection may also be difficult to operate.

Nozzles are also available that adjust to provide a high pressure spray pattern at one setting and a low pressure, dispersed spray pattern at another setting. But the settings included with these nozzles may not always provide the exact spray pattern or flow rate desired. Moreover, the desired setting and spray pattern may be difficult to maintain.

It is known to mount multiple different nozzles on a turret which can be rotated to selectively align one of the different nozzles with a fluid source. For example, U.S. Pat. No. 6,398,134 (Hickson et al.) discloses such a nozzle assembly that mounts directly on the wand of a pressure washer. Spray nozzles are carried by a turret of the assembly to selectively move one of the nozzles into position for attaching directly to the free end of the wand. The free end of the wand has a female quick connect connector for receiving a male end of the selected nozzle. However, only the quick connect connection holds the nozzle and turret in position for spraying.

Also, for example, U.S. Pat. No. 6,435,427 (Conroy) discloses a nozzle assembly in which a turret carries spray nozzles for selective alignment with a fluid outlet. To extend the turret to index the nozzles, a handle is rotated to move the turret out of a housing at which time an alignment pin must be pulled to rotate the turret to select a different nozzle. Manipulating both the handle and alignment pin to change nozzles is inconvenient.

Accordingly, it would be desirable to provide a spray nozzle assembly that securely holds selected spray nozzles in position for discharging fluid from a fluid source and allows easy interchange from one spray nozzle to a different spray nozzle.

SUMMARY OF THE INVENTION

The invention is directed to a spray head for use in a fluid delivery system. The spray head comprises a housing having an inlet for entry of fluid under pressure into the housing and an outlet for exit of fluid under pressure from the housing. In one aspect of the invention, the spray head comprises a turret assembly that comprises a nozzle carrier rotatable relative to the housing about an axis, and a plurality of nozzles on the carrier spaced radially outward from the axis. The turret assembly is mounted for linear movement relative to the housing along the axis from a retracted position in which one of the nozzles is mated with the outlet for the discharge of fluid through the nozzle, to an extended position in which the nozzle carrier is rotatable about the axis to move a different nozzle into alignment with the outlet, and back to the retracted position in which the different nozzle is mated with the outlet. The spray head comprises a latch on the housing moveable radially with respect to the axis between a latching position holding the turret assembly in the retracted position and a release position allowing the turret assembly to move to the extended position.

In another aspect of the invention, the spray head comprises the housing, a shaft having a longitudinal axis mounted in the housing, a nozzle carrier attached to the shaft for movement with the shaft, and a plurality of nozzles on the carrier spaced radially outward from the axis. In this aspect, the shaft and nozzle carrier are mounted for linear movement relative to the housing along the axis from a retracted position in which one of the nozzles is mated with the outlet for the discharge of fluid through the nozzle, to an extended position in which the nozzle carrier is rotatable about the axis to move a different nozzle into alignment with the outlet, and back to the retracted position in which the different nozzle is mated with the outlet. The spray head comprises a latch on the housing moveable between a latching position holding the nozzle carrier in the retracted position and a release position allowing the nozzle carrier to move to the extended position. The latch comprises at least one latching arm, an actuator adapted to be manually depressed in a first generally radial direction with respect to the axis to move the at least one latching arm to a position corresponding to the latching position of the latch in which portions of the latching arm are received in respective recesses in the shaft and the nozzle aligned with the outlet to hold the nozzle carrier in the retracted position, and spring means urging the actuator and latching arm in a second generally radial direction opposite the first generally radial direction toward a position corresponding to the release position of the latch in which the portions on the at least one latching arm are removed from the recesses to allow the nozzle carrier to move to the extended position.

In still another aspect of the invention, the spray head comprises the housing, a shaft having a longitudinal axis and a shaft latching formation mounted in the housing, a nozzle carrier attached to the shaft for movement with the shaft, and a plurality of nozzles on the carrier spaced radially outward from the axis, each nozzle comprising a nozzle latching formation. In this aspect, the shaft and nozzle carrier are mounted for linear movement relative to the housing along the axis from a retracted position in which one of the nozzles is mated with the outlet for the discharge of fluid through the nozzle, to an extended position in which the nozzle carrier is rotatable about the axis to move a different nozzle into alignment with the outlet, and back to the retracted position in which the different nozzle is mated with the outlet. The spray head comprises a latch on the housing moveable between a latching position holding the nozzle carrier in the retracted position and a release position allowing the nozzle carrier to move to the extended position. The latch comprises engagement structure for engaging the shaft at its shaft latching formation and for engaging the nozzle aligned with the outlet at its nozzle latching formation to hold the nozzle carrier in the retracted position.

Other features of the invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE INVENTION

Figure 1:
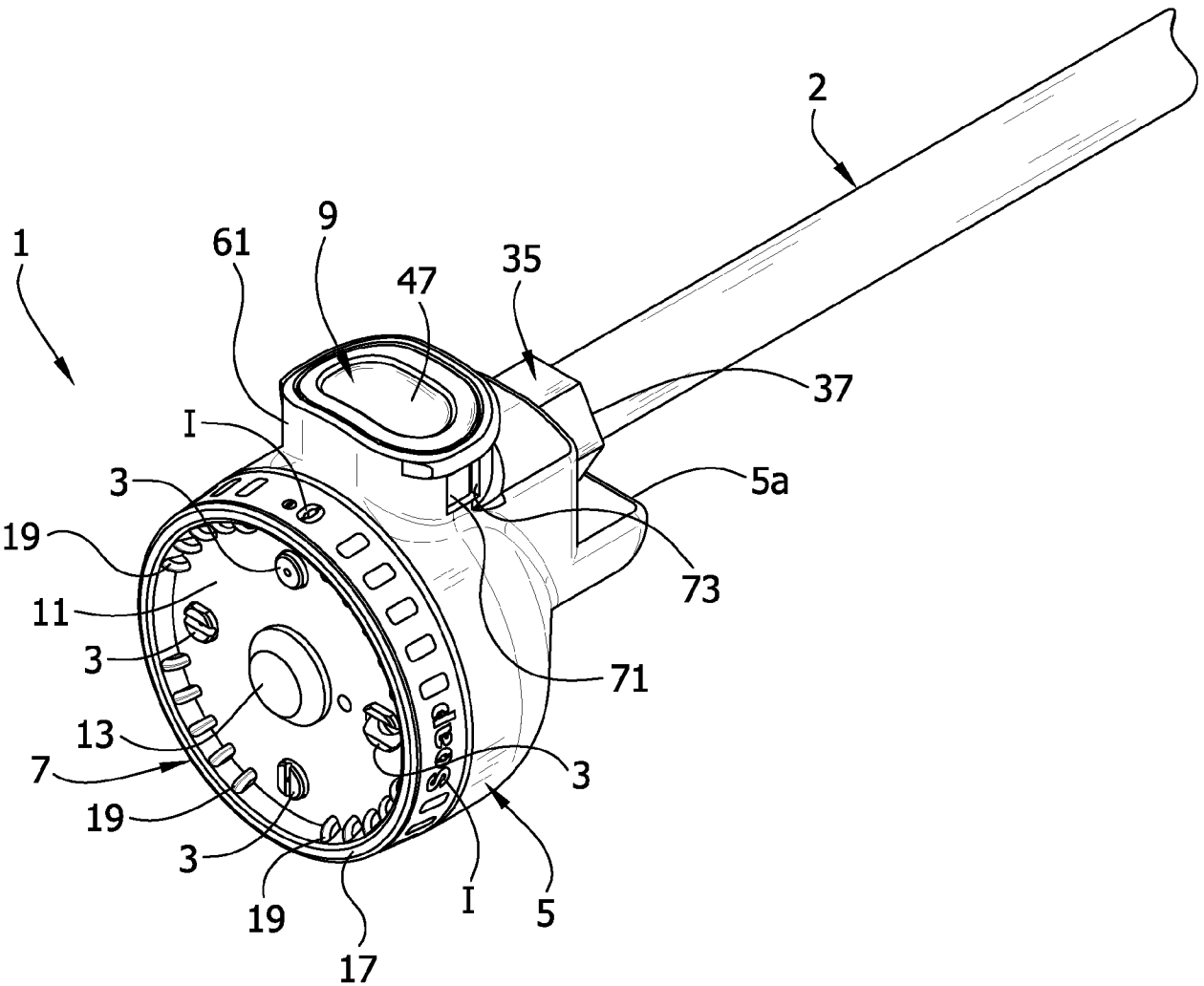
FIG. 1 is a perspective view of a spray head of the invention mounted on a pressure washer wand.
Figure 2:
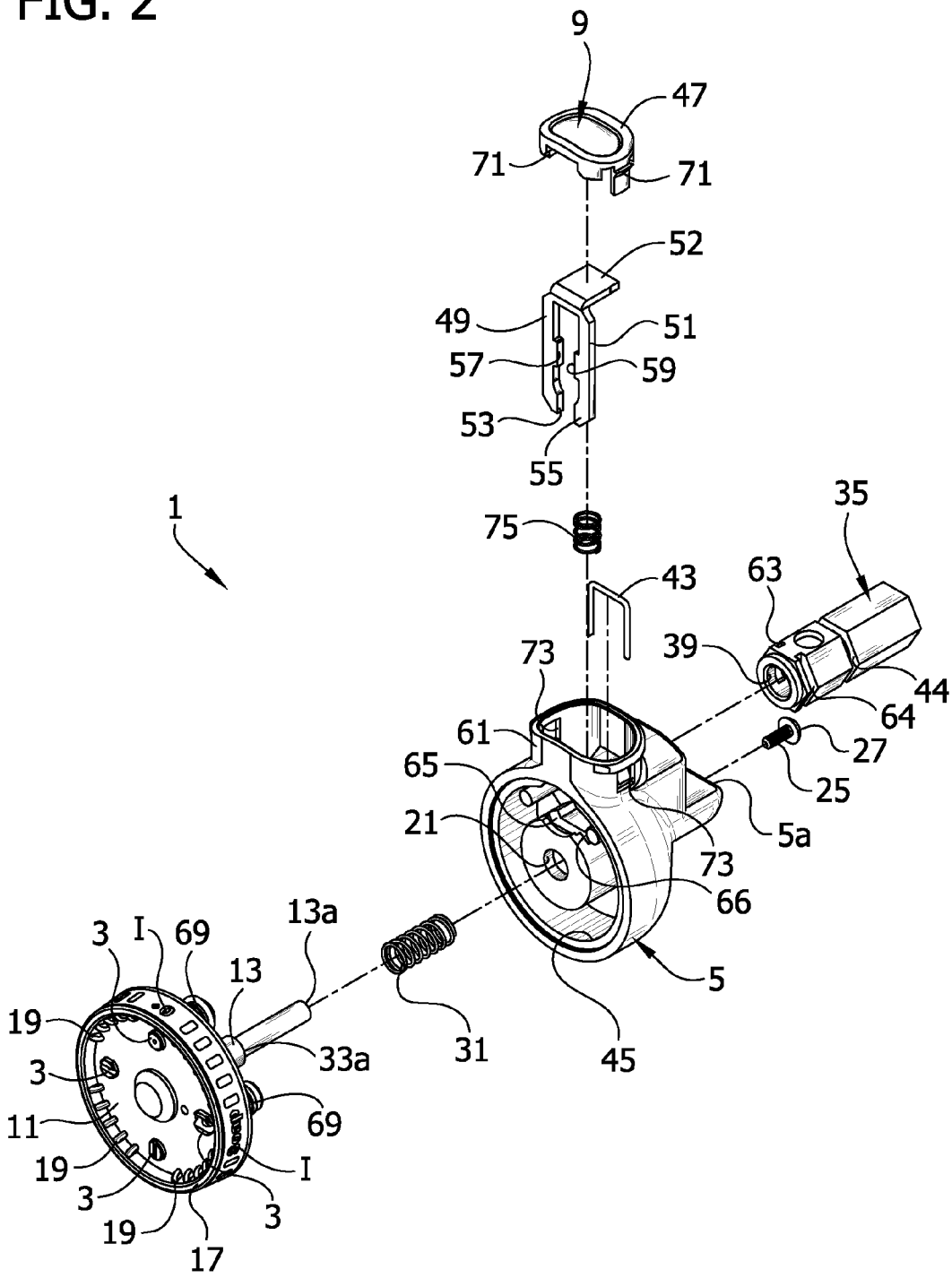
FIG. 2 is an exploded perspective view of the spray head.

Referring now to the drawings, a spray head according to the general principals of the present invention is shown generally at 1. As shown in FIG. 1, the spray head 1 attaches to a wand 2 of a pressure washer (not shown) for discharging fluid under pressure from the pressure washer through one of four spray nozzles, each shown at 3. As can be seen, the spray head 1 generally comprises a housing (shown generally at 5) which connects to the wand 2, a turret assembly (shown generally at 7) for carrying the spray nozzles 3, and a latch (shown generally at 9) for securing the turret assembly 7 and spray nozzles 3 in a retracted position with respect to the housing 5. While the illustrated spray head 1 includes four spray nozzles 3, a spray head with more or fewer spray nozzles is within the scope of the invention.

Figure 3:
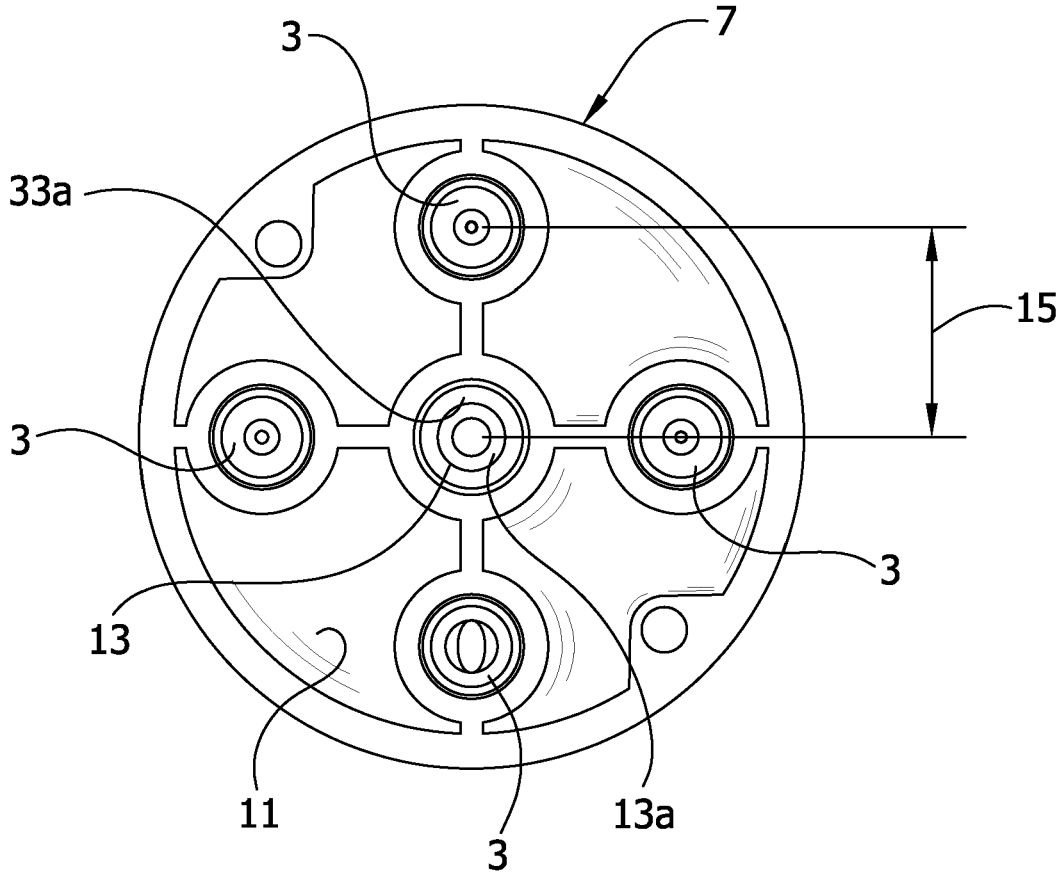
FIG. 3 is a rear end view of a turret assembly of the spray head.
Figure 4:
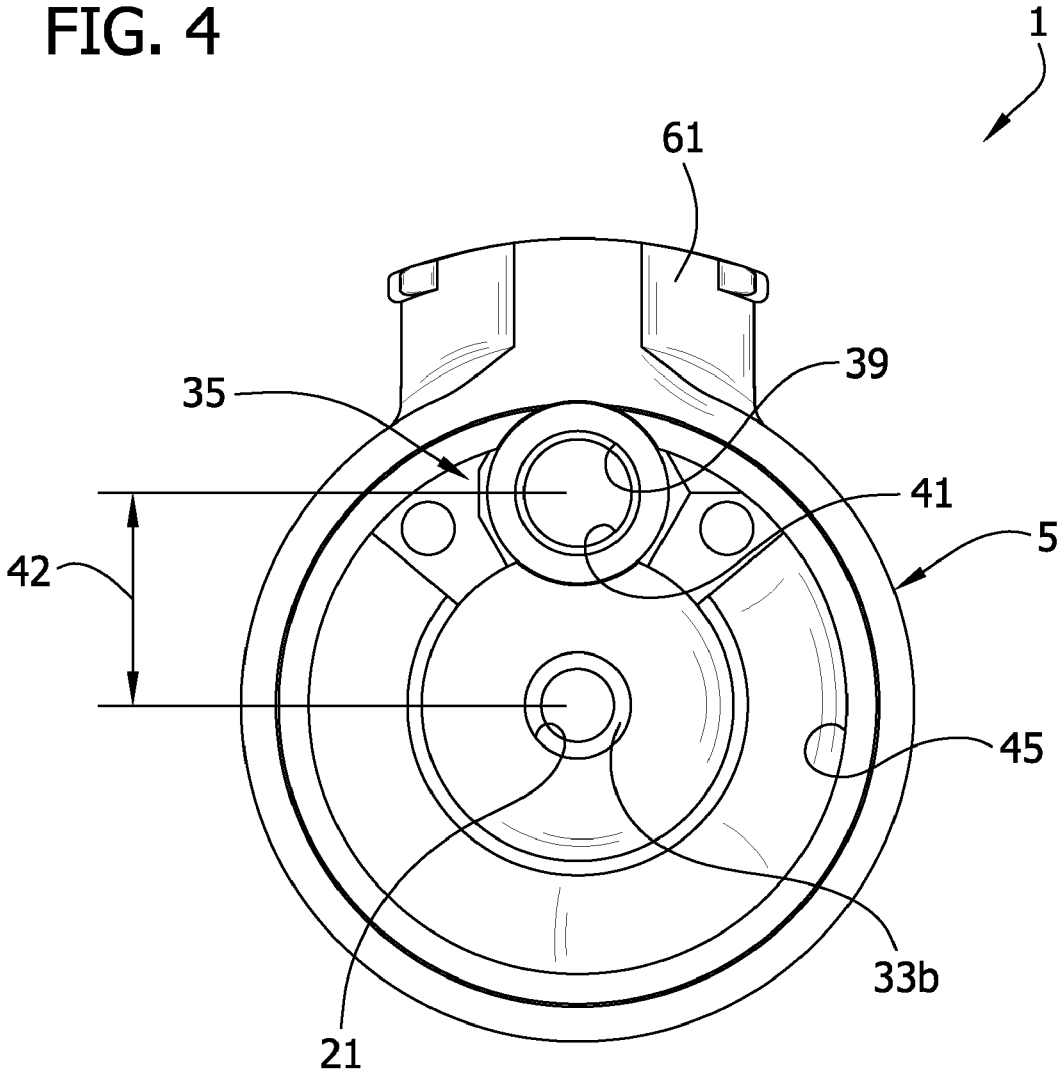
FIG. 4 is a front end view of a housing of the spray head.
Figure 5:
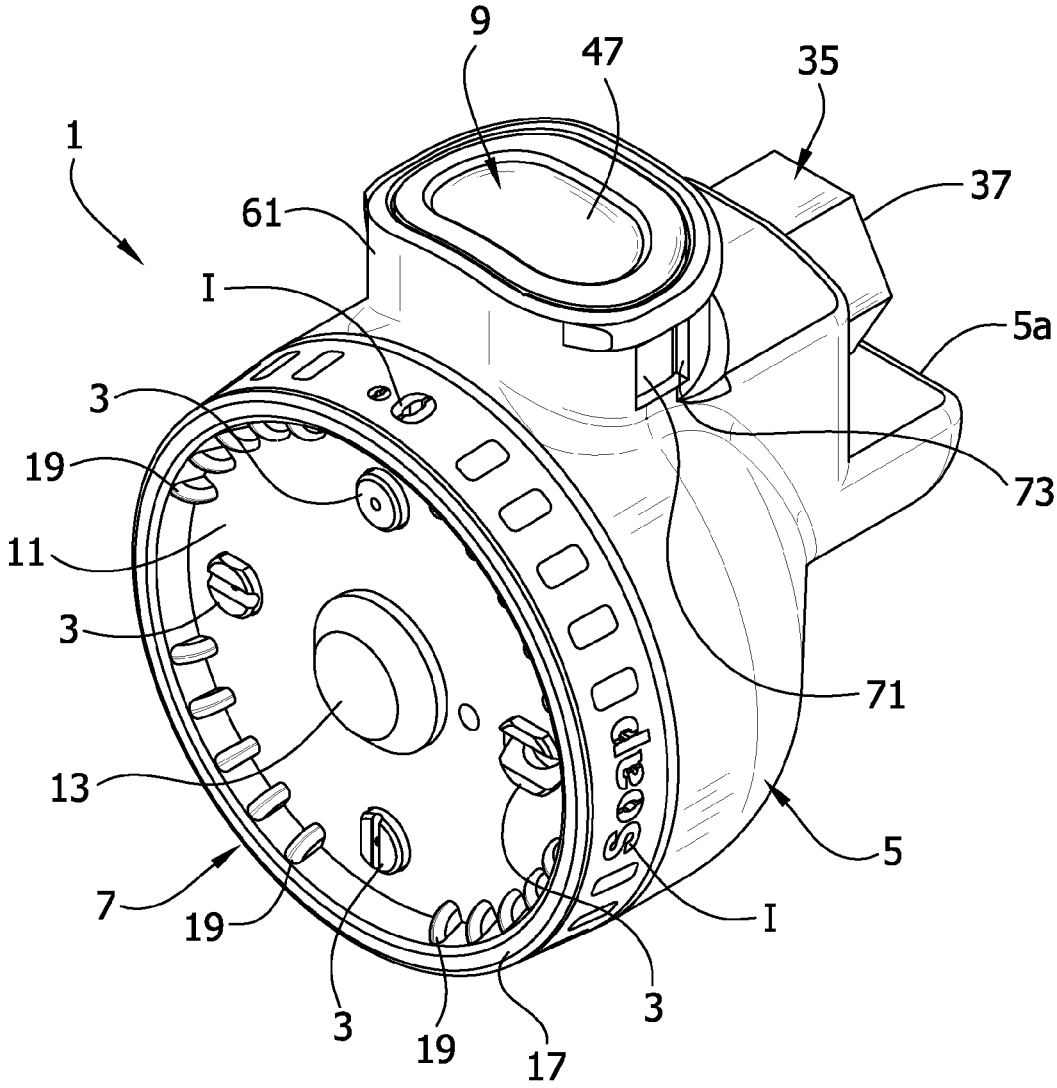
FIG. 5 is a perspective view of the spray head with a carrier of the turret assembly in a retracted position.
Figure 6:
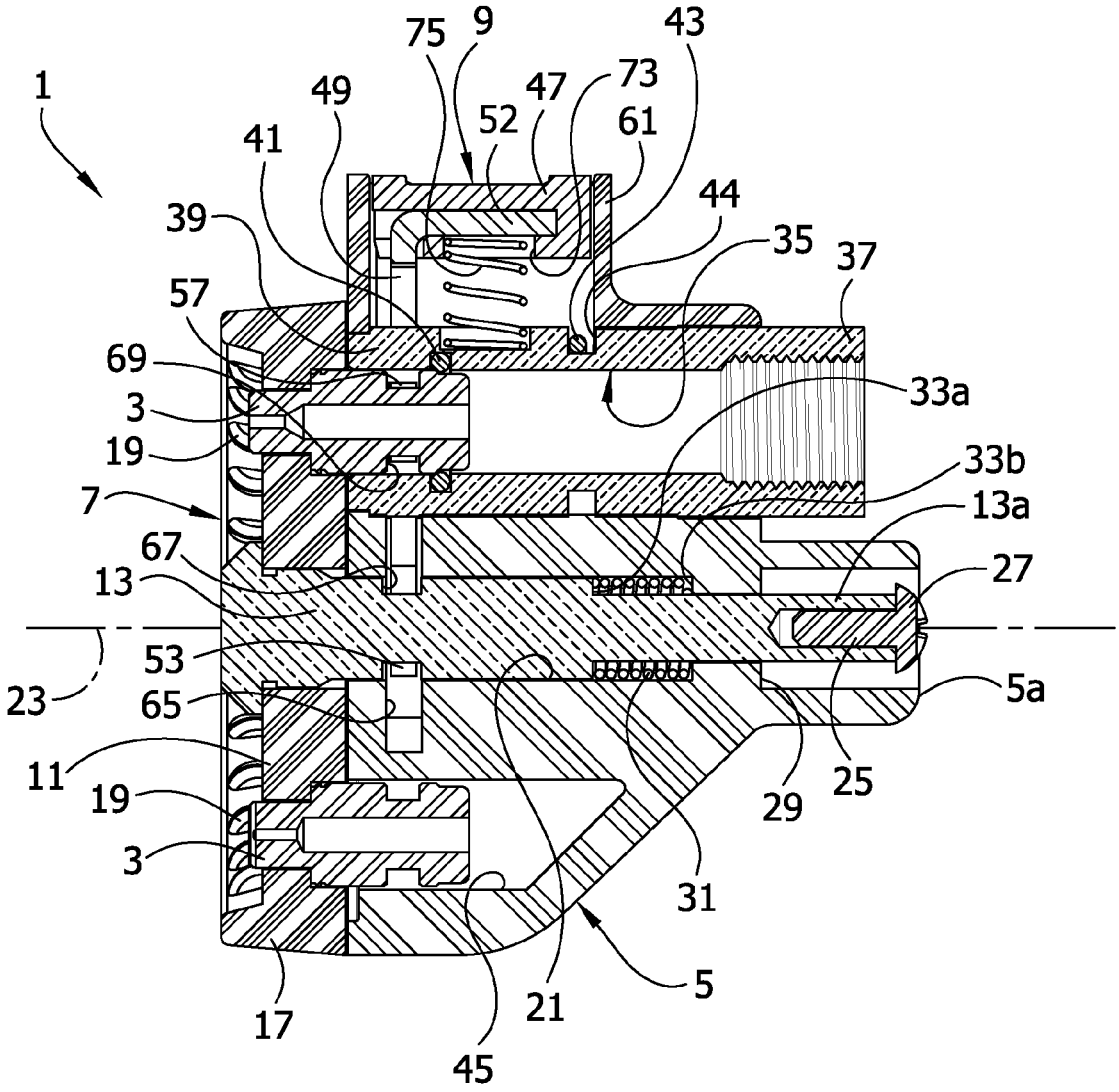
FIG. 6 is a longitudinal section view of the spray head of FIG. 5.
Figure 7:
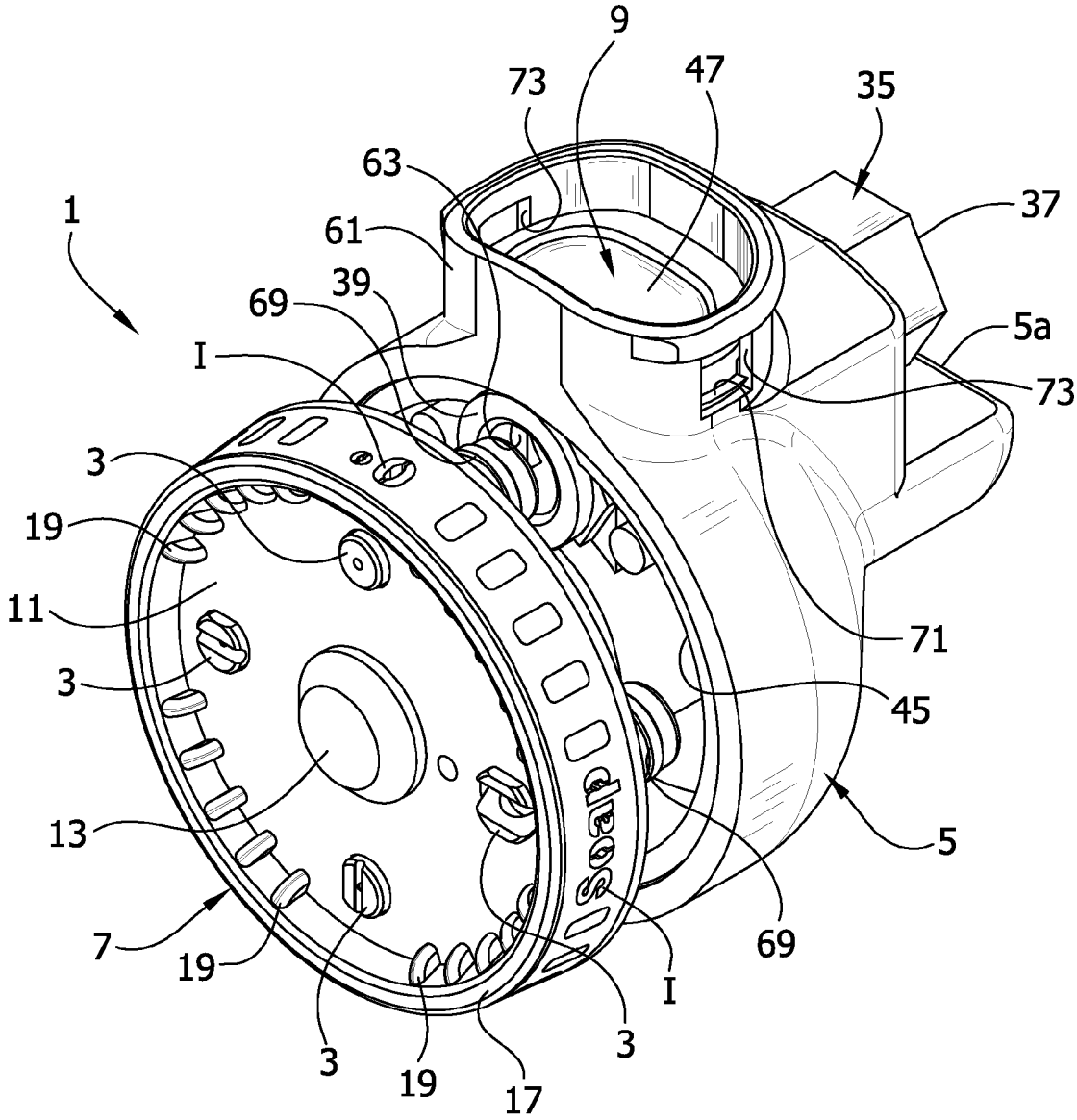
FIG. 7 is the perspective view of FIG. 3 with the carrier in an extended position.

With reference now to FIGS. 2–8, the turret assembly 7 comprises a thin, circular disk, or carrier 11, centrally mounted on a shaft 13. The shaft 13 may be formed integral with the carrier 11, or it may be separately attached thereto, for example by a threaded connection. The spray nozzles 3 are symmetrically mounted on the carrier 11 at locations offset radially outward from the shaft 13 a distance 15 (FIG. 3). The nozzles 3 may be press fit into the carrier 11, threaded, or otherwise attached. As can be seen in FIGS. 1, 5, and 7, the illustrated carrier 11 includes labeling indicia (each shown at I, for example "Soap") on a rim 17 of the carrier 11 describing the fluid or spray pattern discharged from the corresponding nozzle 3 located radially inward from the indicia I. It is understood that the invention does not require such labeling indicia. Ribs 19 are located inward of the rim 17 to provide support to the rim.

The housing 5 receives the shaft 13 through a central opening 21 in the housing 5, allowing the shaft 13 to slide linearly in the housing 5 along an axis 23 and to rotate in the housing 5 about the same axis 23 (see FIG. 6). Movement of the shaft 13 moves the carrier 11 between a retracted position (FIGS. 5 and 6) in which the spray nozzles 3 are received in the housing 5 for spraying operation and an extended position (FIGS. 7 and 8) in which the carrier 11 and spray nozzles 3 are spaced from the housing 5 and are rotatable relative to the housing 5 for selecting a different spray nozzle 3 for spraying operation.

Figure 8:
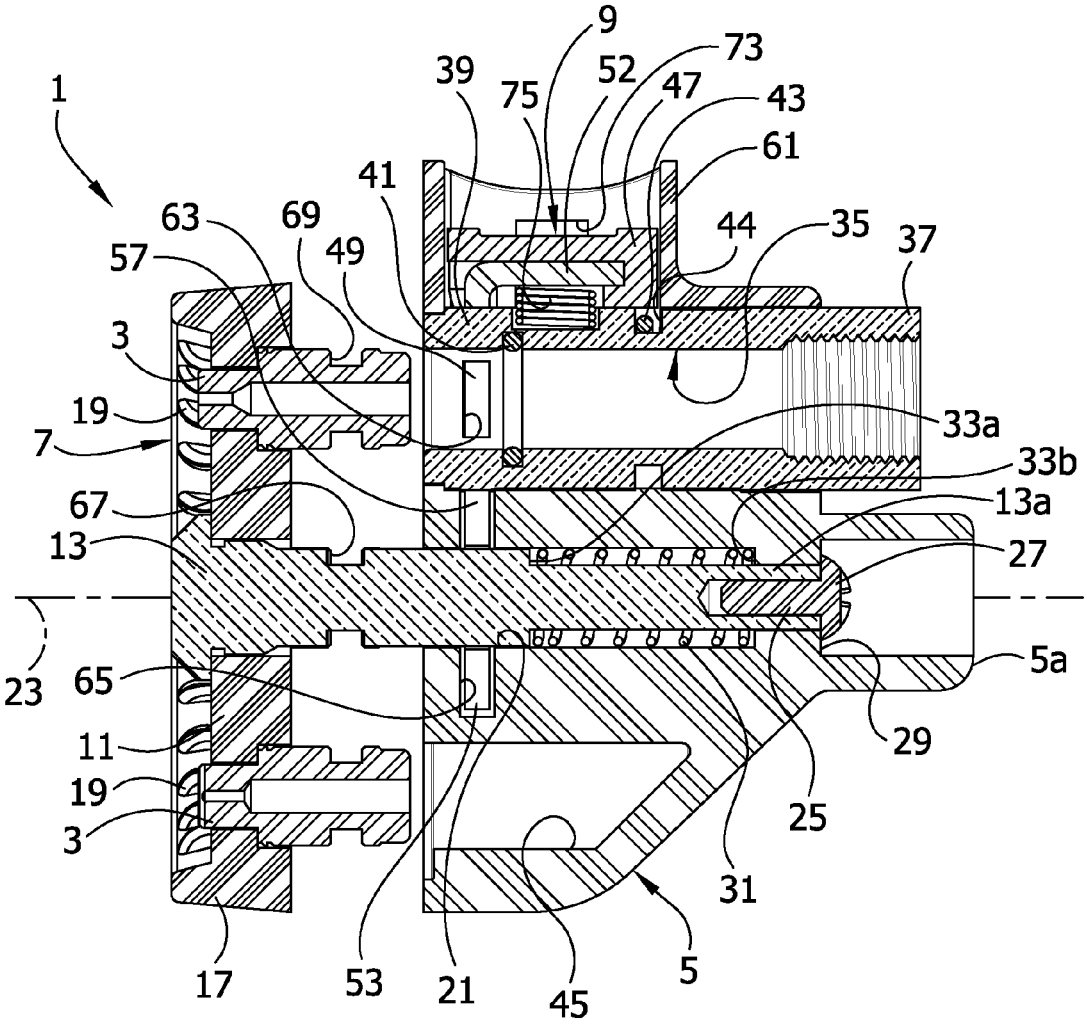
FIG. 8 a longitudinal section view of the spray head of FIG. 7.
Figure 9:
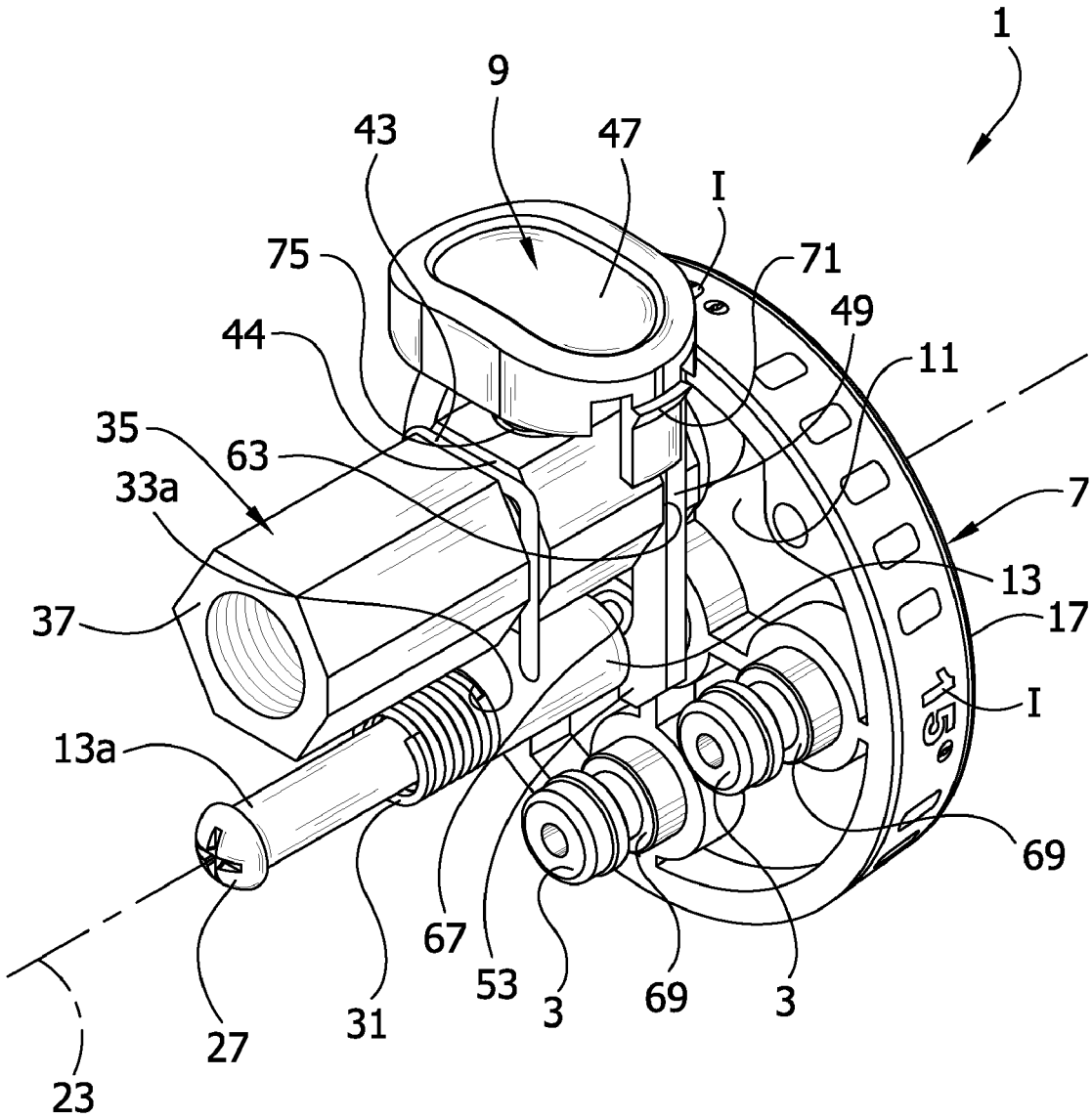
FIG. 9 is a perspective view of the spray head with the housing removed to see internal construction.
Figure 10:
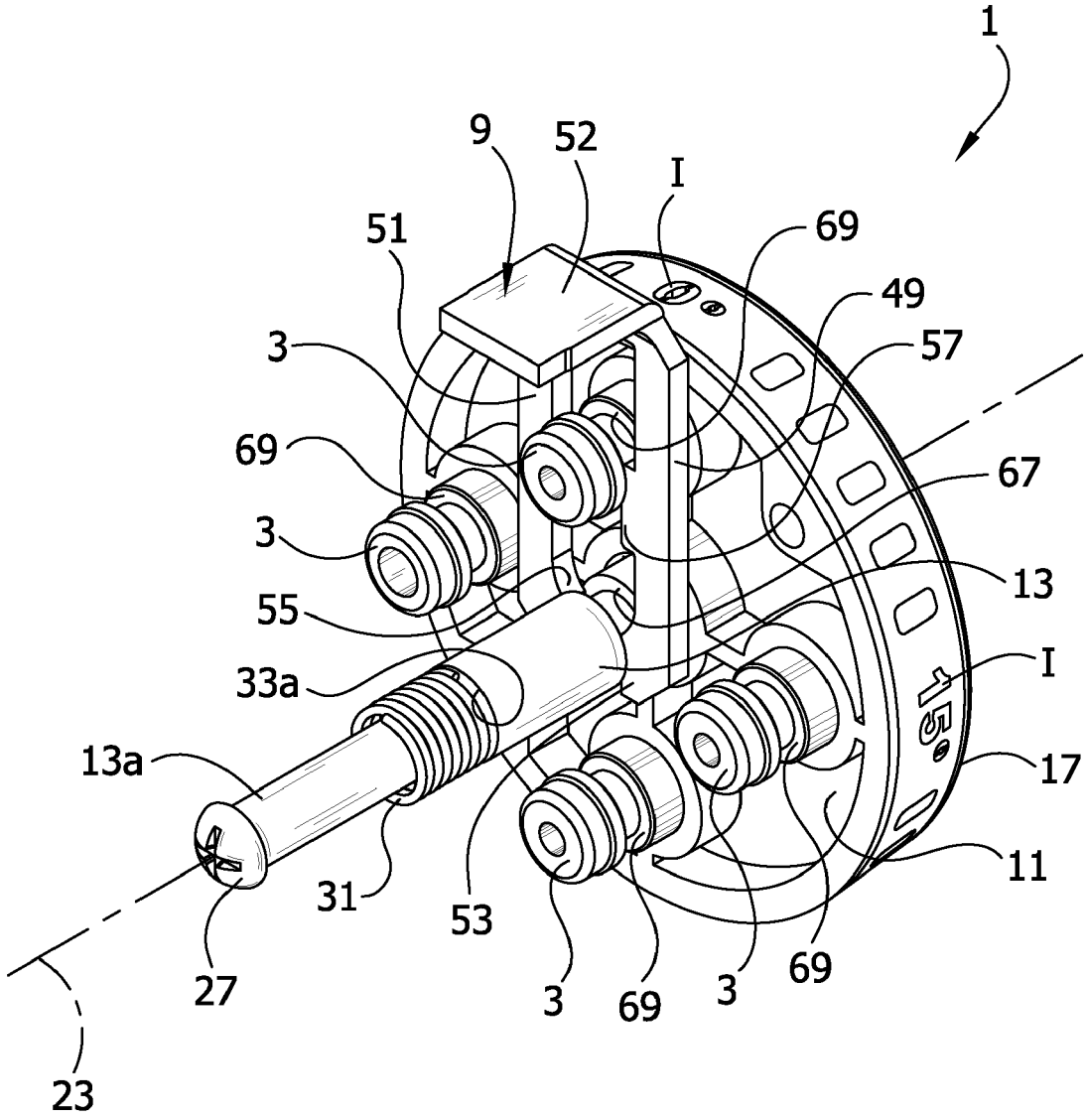
FIG. 10 is the perspective view of FIG. 9 with a fluid channel removed and part of a latch removed.

The shaft 13 is slidably retained in the central opening 21 of the housing 5 by a screw 25 threaded into a rear end 13*a* of the shaft 13. When the carrier 11 is in the retracted position, the screw 25 is generally flush with a rear end 5*a* of the housing 5 (FIG. 6). When the carrier 11 moves to its extended position (FIG. 8), a head 27 of the screw 25 contacts an internal shoulder 29 in the central opening 21 to limit the forward movement of the shaft 13 and carrier 11 (FIG. 8). It can be seen that the distance between the rear end 5*a* of the housing 5 and the shoulder 29 is about the same distance required to move the nozzles 3 out of engagement with the housing 5 so that the carrier 11 can rotate when in its extended position.

A turret spring 31 is located around the turret shaft 13 within the central opening 21 of the housing 5. As shown best in FIGS. 6 and 8, the spring 31 is located between an external shoulder 33*a* of the shaft 13 and an internal shoulder 33*b* in the opening 21. The spring 31 urges the turret assembly 7 to move from the retracted position to the extended position.

A fluid channel 35 is located in the housing 5 generally above the central opening 21. An inlet 37 of the channel is threaded for connecting the housing 5 to the pressure washer wand 2 (FIG. 1) for receiving fluid from the wand 2 into the housing 5 under pressure. An outlet 39 (FIGS. 2 and 8) of the channel 35 receives a selected spray nozzle 3 from the carrier 11 for discharging the fluid from the housing 5. Each spray nozzle 3 corresponds in size (diameter-wise) to the size of the outlet 39 so that the selected spray nozzle 3 securely fits in the outlet 39 but is still capable of sliding movement into and out of the outlet 39. When the selected spray nozzle 3 is received in the outlet 39 during spraying operation, it is sealed against the inner surface of the outlet 39 by an O-ring 41 to prevent leakage of fluid around the nozzle 3 (FIG. 6).

The fluid channel 35 is offset from the central opening 21 a radial distance 42 (FIG. 4) that is generally the same as the radial distance 15 between the shaft 13 and each nozzle 3 of the carrier 11 (FIG. 3). Accordingly, when the carrier 11 is in the retracted position the selected spray nozzle 3 is accurately received in the outlet 39 of the fluid channel 35. In the illustrated embodiment, the perimeter of the fluid channel 35 is hex shaped. The hex shape allows an operator to use a wrench to rotate the fluid channel 35 and thread it and the housing 5 onto the pressure washer wand 2. However, the perimeter of the fluid channel 35 may be shaped differently within the scope of the invention. For example, a key way may be provided in the fluid channel 35 for receiving a key (e.g., an allen wrench) to thread the fluid channel 35 and housing 5 onto the pressure washer wand 2. Furthermore, the outlet 39 of the channel 35 may connect to the pressure washer wand 2 differently and not deviate from the invention (e.g., a ball-bearing quick-connect connection). Also in the illustrated embodiment, the fluid channel 35 is secured in the housing by a retainer 43 received in a groove 44 in the channel. The fluid channel 35 may be secured in the housing 5 in other ways, or it may be formed as an integral part of the housing.

An annular recess 45 extends around the front face of the housing 5 for accommodating each spray nozzle 3 not selected during spraying operation (i.e., each nozzle 3 not received in the outlet 39 of the fluid channel 35). The recess 45 is offset from the central opening 21 generally the same distance 42 as the fluid channel 35 (FIG. 4). Accordingly, when the carrier 11 is in its retracted position and the selected nozzle 3 is received in the outlet 39, the other spray nozzles 3 fit within the annular recess 45.

The latch 9 of the spray head 1 is shown in FIGS. 2 and 9–12. The latch 9 comprises an actuator 47 and at least one latching arm and preferably two latching arms 49, 51 extending from the actuator 47. In the illustrated embodiment, a bridge 52 connects the two arms 49, 51 and is slidably received in the actuator 47, which is shown as a cap, for joint movement. A spray head in which one or more latching arms are integral with an actuator is within the scope of the invention. Each arm 49, 51 of the latch 9 includes first and second tabs (broadly, "latching portions" or "engagement structure") 53, 55 and 57, 59 spaced apart along the respective arm 49, 51. The first tabs 53, 55 are located adjacent the lower ends of the arms 49, 51 and the second tabs 57, 59 are located approximately midway between the first tabs 53, 55 and the actuator 47.

Figure 11:
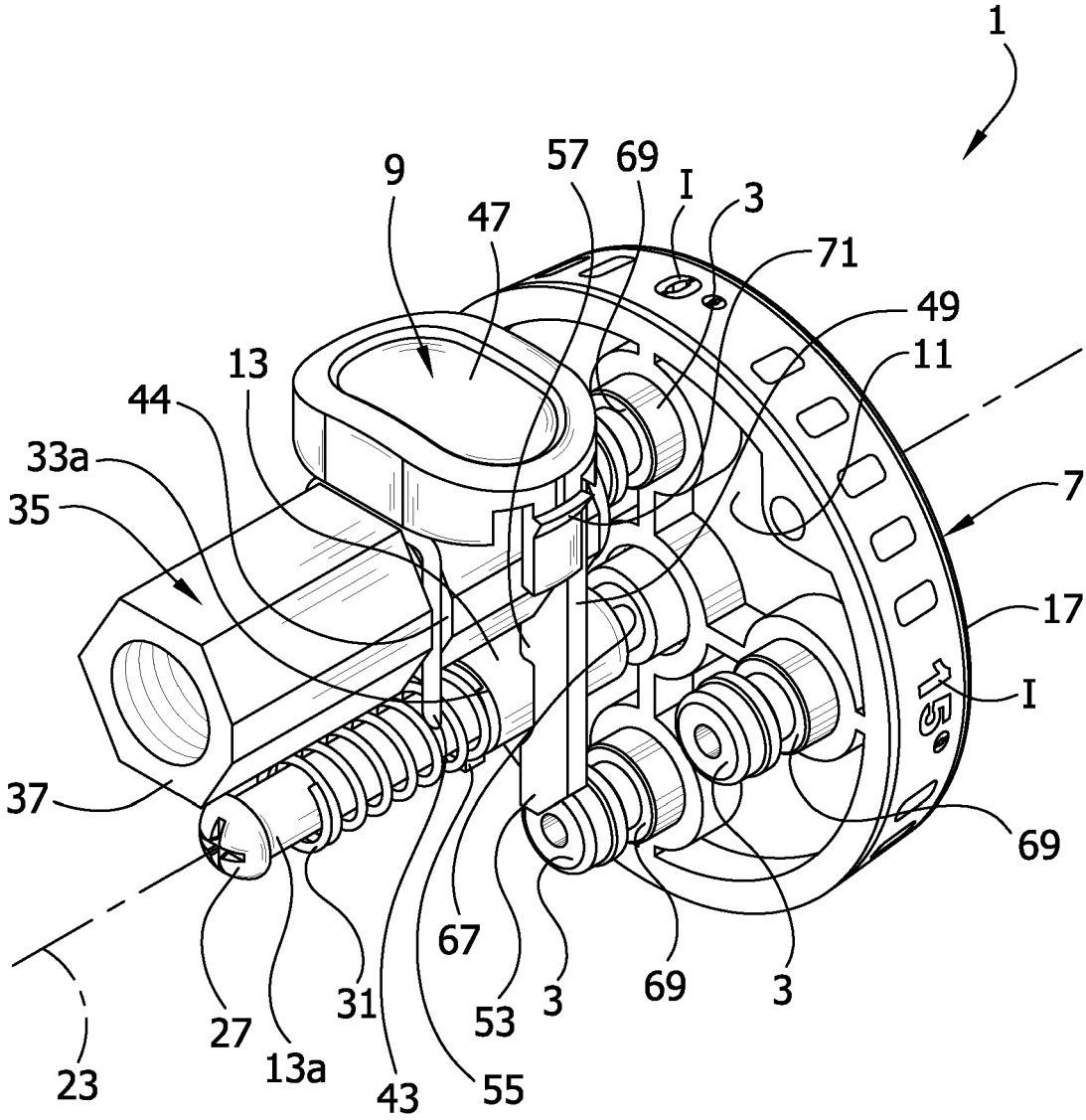
FIG. 11 is the perspective view of FIG. 9 with the carrier in the extended position.
Figure 12:
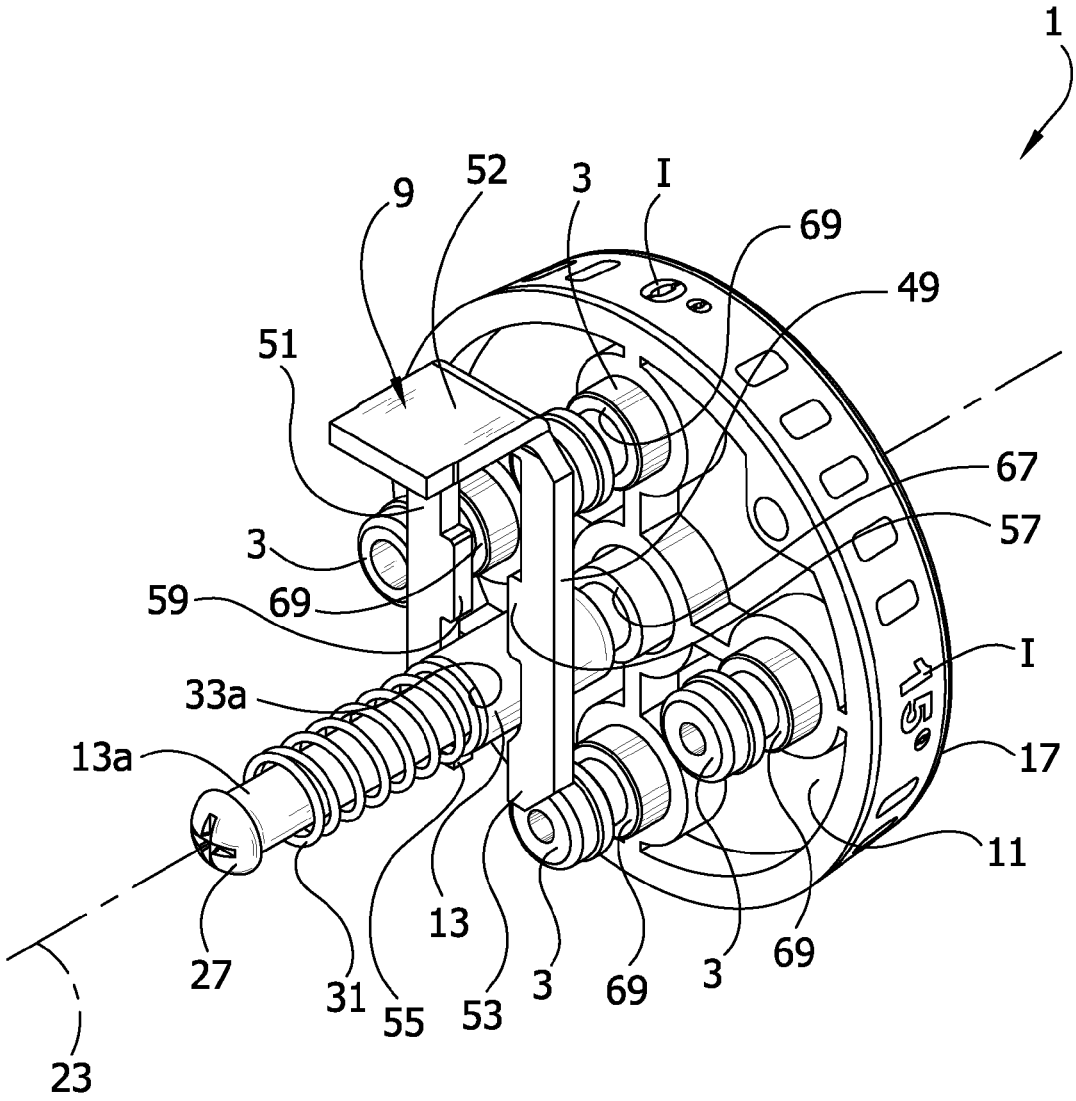
FIG. 12 is the perspective view of FIG. 11 with the fluid channel removed and part of the latch removed.

The actuator 47 mounts on the housing 5 within an open cradle 61 on top of the housing 5 for movement in a generally radial direction relative to the axis 23 of movement of the shaft 13 and carrier 11. The arms 49, 51 of the actuator 47 extend radially inward of the housing 5 through slots 63, 64 in the fluid channel 35 and into slots 65, 66 in the housing 5 which communicates with the central opening 21 so that the arms 49, 51 straddle the fluid channel 35 and carrier shaft 13. In this position, the actuator 47 is moveable radially relative to the housing 5 between a latching position (FIGS. 9 and 10) and a release position (FIGS. 11 and 12). In the latching position, the first tabs 53, 55 are received in the slots 65, 66 and project into a circumferential groove, or recess (broadly, a "latching recess" or "latching formation") 67 in the shaft 13 and the second tabs 57, 59 are received in the slots 63, 64 in the fluid channel 35 and project into a circumferential groove, or recess (again broadly, a "latching recess" or "latching formation") 69 in the selected nozzle 3. As a result, the tabs 53, 55, 57, 59 hold the shaft 13 and the carrier 11 in the retracted position against the bias of the turret spring 31. In the release position, the tabs 53, 55 and 57, 59 are removed from the respective grooves 67, 69 so that the shaft 13 and selected nozzle 3, and thus the carrier 11, can move relative to the actuator 47 between the latching arms 49, 51 to the extended position under the urging of the turret spring 31. Ears 71 of the actuator 47 fit within slots 73 of the cradle 61 to limit the radial movement of the actuator 47 and arms 49, 51.

To change from one selected nozzle 3 to another selected nozzle in the spray head 1, the actuator 47 is depressed manually against the urging of a latch spring 75 to move it to the stated release position (FIGS. 7, 8, 11, and 12). The first and second tabs 53, 55 and 57, 59 move out of the grooves 67, 69 in the shaft 13 and the selected nozzle 3, respectively, to a position generally below the grooves 67, 69 as viewed in FIGS. 11 and 12, allowing the turret spring 31 to urge the carrier 11 and shaft 13 away from the housing 5 to the extended position. When the actuator 47 is in its depressed position, the latch spring 75 tends to urge it radially outward (i.e., away from the shaft 13). However, the diameter of the shaft 13 away from the circumferential groove 67 is greater than the lateral space between the first tabs 53, 55 so that the first tabs are held below the shaft 13 when the carrier 11 and shaft 13 are in the extended position, thus holding the actuator 47 in the depressed position (FIGS. 11 and 12). The carrier 11 and shaft 13 are then rotated to align a different nozzle 3 with the outlet 39 in the fluid channel 35. After the carrier 11 has been rotated to the desired position, the carrier 11 and shaft 13 are pushed manually toward the housing 5 against the bias of the turret spring 31 to a position where the first and second tabs 53, 55 and 57, 59 align with the grooves 67, 69 in the shaft 13 and selected nozzle 3, respectively. The latch spring 75 then urges the actuator 47 to move into the latching position in which the tabs 53, 55 and 57, 59 of the latching arms 49, 51 are again received in the grooves 67, 69 of the shaft 13 and selected nozzle 3.

In the illustrated embodiment, the latch spring 75 is a coil spring. It is contemplated that a different spring could be used within the scope of the invention (e.g., a torsion spring), or that one or more springs could be used in cooperation, or that other biasing devices that provide a spring action for urging the actuator 47 radially outward after being depressed could be used in place of the coil spring. For example, a flexible rubber block could be positioned between the actuator 47 and the fluid channel 35 so that when the actuator 47 is depressed, the rubber block compresses and urges the actuator 47 radially outward. Also for example, a piston could be used to provide a similar urge.

Components of the spray head 1, including the housing 5 and carrier 11, may be formed from a high density plastic, or other rigid material, using a mold process. The fluid channel 35 and spray nozzles 3 of the spray head 1 may be made of corrosion resistant material, such as brass. Components formed differently or made of a different material do not depart from the scope of the invention.

In view of the above, it will be seen that the several features of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A spray head for use in a fluid delivery system, said spray head comprising:

a housing having an inlet for entry of fluid under pressure into the housing and an outlet for exit of fluid under pressure from the housing;

a turret assembly comprising a nozzle carrier rotatable relative to the housing about an axis, and a plurality of nozzles on the carrier spaced radially outward from said axis;

said turret assembly being mounted for linear movement relative to the housing along said axis from a retracted position in which one of said nozzles is mated with said outlet for the discharge of fluid through the nozzle, to an extended position in which the nozzle carrier is rotatable about said axis to move a different nozzle into alignment with said outlet, and back to said retracted position in which said different nozzle is mated with said outlet; and a latch on the housing moveable radially with respect to said axis between a latching position holding said turret assembly in said retracted position and a release position allowing said turret assembly to move to said extended position.

2. A spray head as set forth in claim 1 wherein said latch comprises at least one latching arm and said turret assembly comprises at least one latching recess for receiving a portion of said latching arm when said latch is in its latching position.

3. A spray head as set forth in claim 2 wherein said at least one latching recess comprises a recess in said nozzle for receiving said portion of the at least one latching arm when the latch is in its latching position.

4. A spray head as set forth in claim 3 further comprising a latch spring for urging said at least one latching arm toward said latching position, said latch spring urging said portion of the latching arm into said nozzle recess when the turret assembly moves to said retracted position.

5. A spray head as set forth in claim 2 wherein the turret assembly further comprises a shaft movable in the housing along said axis, said nozzle carrier being mounted on the shaft.

6. A spray head as set forth in claim 5 wherein said at least one latching recess comprises a recess in said shaft for receiving said portion of the at least one latching arm when the latch is in its latching position, said portion of the latching arm constituting a shaft-latching portion of the latching arm.

7. A spray head as set forth in claim 6 further comprising a latch spring for urging said at least one latching arm toward said latching position, said latch spring urging said shaft-latching portion of the latching arm into said shaft recess when the shaft moves to said retracted position.

8. A spray head as set forth in claim 6 wherein said at least one latching recess further comprises a recess in said nozzle aligned with said outlet for receiving a nozzle-latching portion of said at least one latching arm when the latch is in its latching position.

9. A spray head as set forth in claim 8 wherein said shaft-latching and nozzle-latching portions of the at least one latching arm comprises first and second projecting tabs spaced from one another along the arm.

10. A spray head as set forth in claim 5 wherein the latch comprises two generally parallel latching arms spaced apart for straddling said shaft and aligned nozzle, each latching arm having latching portions receivable in respective recesses in said shaft and nozzle.

11. A spray head as set forth in claim 5 wherein the shaft is mounted in the housing for both rotational and axial movement of the shaft relative to the housing, and wherein the nozzle carrier is mounted on the shaft such that it moves with the shaft but not relative to the shaft.

12. A spray head as set forth in claim 11 wherein said outlet receives the nozzle aligned with the outlet when the turret assembly is in its retracted position.

13. A spray head as set forth in claim 12 wherein the nozzle carrier comprises a circular disk, and wherein said plurality of nozzle comprises at least four nozzles spaced symmetrically around the disk a radial distance from said axis generally corresponding to a radial distance of the outlet from said axis.

14. A spray head as set forth in claim 13 wherein said nozzles are non-removably attached to said nozzle carrier.

15. A spray head as set forth in claim 2 wherein said at least one latching arm is spring-biased toward said latching position, and wherein said latch further comprises an actuator which is manually depressed to move said latch from said latching position in which said portion of the latching arm is received in said latching recess to said release position in which said portion of the latching arm is removed from said latching recess.

16. A spray head as set forth in claim 15 further comprising a turret spring for urging said turret assembly from its retracted position to its extended position when said actuator is manually depressed.

17. A spray head as set forth in claim 1 in combination with a pressure washer comprising a wand, said spray head having a connection with said wand for delivery of fluid under pressure from the wand to the spray head.

18. A spray head for use in a fluid delivery system, said spray head comprising:

a housing having an inlet for entry of fluid under pressure into the housing and an outlet for exit of fluid under pressure from the housing;

a shaft mounted in the housing, said shaft having a longitudinal axis;

a nozzle carrier attached to the shaft for movement with the shaft;

a plurality of nozzles on the carrier spaced radially outward from said axis;

said shaft and nozzle carrier being mounted for linear movement relative to the housing along said axis from a retracted position in which one of said nozzles is mated with said outlet for the discharge of fluid through the nozzle, to an extended position in which the nozzle carrier is rotatable about said axis to move a different nozzle into alignment with said outlet, and back to said retracted position in which said different nozzle is mated with said outlet; and a latch on the housing moveable between a latching position holding said nozzle carrier in said retracted position and a release position allowing said nozzle carrier to move to said extended position;

said latch comprising at least one latching arm, an actuator adapted to be manually depressed in a first generally radial direction with respect to said axis to move the at least one latching arm to a position corresponding to said latching position of the latch in which portions of the latching arm are received in respective recesses in the shaft and the nozzle aligned with said outlet to hold said nozzle carrier in said retracted position, and spring means urging said actuator and latching arm in a second generally radial direction opposite said first generally radial direction toward a position corresponding to said release position of the latch in which said portions on the at least one latching arm are removed from said recesses to allow said nozzle carrier to move to said extended position.

19. A spray head as set forth in claim 18 further comprising a spring for moving said shaft and nozzle carrier to said extended position when said latch is in said release position.

20. A spray head for use in a fluid delivery system, said spray head comprising:

a housing having an inlet for entry of fluid under pressure into the housing and an outlet for exit of fluid under pressure from the housing;

a shaft mounted in the housing, said shaft having a longitudinal axis and a shaft latching formation;

a nozzle carrier attached to the shaft for movement with the shaft;

a plurality of nozzles on the carrier spaced radially outward from said axis, each nozzle comprising a nozzle latching formation;

said shaft and nozzle carrier being mounted for linear movement relative to the housing along said axis from a retracted position in which one of said nozzles is mated with said outlet for the discharge of fluid through the nozzle, to an extended position in which the nozzle carrier is rotatable about said axis to move a different nozzle into alignment with said outlet, and back to said retracted position in which said different nozzle is mated with said outlet; and a latch on the housing moveable between a latching position holding said nozzle carrier in said retracted position and a release position allowing said nozzle carrier to move to said extended position;

said latch comprising engagement structure for engaging said shaft at its shaft latching formation and for engaging said nozzle aligned with said outlet at its nozzle latching formation to hold said nozzle carrier in said retracted position.

* * * * *